US011401847B2

(12) United States Patent
Dadam et al.

(10) Patent No.: US 11,401,847 B2
(45) Date of Patent: Aug. 2, 2022

(54) METHODS AND SYSTEMS FOR AN EXHAUST TUNING VALVE

(71) Applicant: Ford Global Technologies, LLC, Dearborn, MI (US)

(72) Inventors: Sumanth Reddy Dadam, Dearborn, MI (US); Vinod Kumar Ravi, Canton, MI (US); Hani Mohammad Ayesh, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 415 days.

(21) Appl. No.: 16/565,398

(22) Filed: Sep. 9, 2019

(65) Prior Publication Data

US 2021/0071555 A1 Mar. 11, 2021

(51) Int. Cl.
*F01N 1/16* (2006.01)

(52) U.S. Cl.
CPC ..... *F01N 1/16* (2013.01); *F01N 2240/36* (2013.01); *F01N 2900/04* (2013.01); *F01N 2900/10* (2013.01)

(58) Field of Classification Search
CPC . F01N 1/16–22; F01N 13/087; F01N 2240/36
See application file for complete search history.

(56) References Cited

U.S. PATENT DOCUMENTS 5,060,271 A 10/1991 Geddes
5,835,605 A 11/1998 Kunimoto
5,919,244 A 7/1999 Danz et al.
6,553,301 B1 4/2003 Chhaya et al.
7,155,333 B1 12/2006 Abram et al.
7,561,054 B2 7/2009 Raz et al.
9,206,726 B2 12/2015 Cuellar et al.
9,540,995 B2 1/2017 Houtschilt et al.
9,824,505 B2 11/2017 Tseng et al.
2004/0226537 A1 11/2004 Held et al.
2005/0189166 A1 9/2005 Kikuchi et al.
2008/0152159 A1 6/2008 Kassner
2010/0209891 A1 8/2010 Lin et al.
2010/0209892 A1 8/2010 Lin et al.
2015/0100221 A1 4/2015 Routledge et al.
2015/0235485 A1 8/2015 Nemat-Nasser et al.
2016/0090885 A1* 3/2016 Holsch ..... G10K 11/17883 701/102
2016/0123210 A1 5/2016 Dmytrow et al.
2017/0234180 A1* 8/2017 Petley ..... H04R 29/001 381/71.1

(Continued)

FOREIGN PATENT DOCUMENTS

CA 1195841 A 10/1985
CN 101633359 A 1/2010

(Continued)

*Primary Examiner* — Jonathan R Matthias
(74) *Attorney, Agent, or Firm* — Vincent Mastrogiacomo; McCoy Russell LLP

(57) ABSTRACT

Methods and systems are provided for an exhaust tuning valve. In one example, a method may include adjusting the exhaust tuning valve in response to a steering wheel angle input. Additionally or alternatively, the position of the exhaust tuning valve may be adjusted differently in response to a same steering wheel angle input during different driving behaviors.

20 Claims, 6 Drawing Sheets

(56) References Cited

U.S. PATENT DOCUMENTS

| | | | |
|---|---|---|---|
| 2017/0248048 | A1 | 8/2017 | Dziurda et al. |
| 2018/0128145 | A1* | 5/2018 | Uhrich ..... F01N 1/168 |
| 2019/0120101 | A1 | 4/2019 | Dadam et al. |

FOREIGN PATENT DOCUMENTS

| | | | |
|---|---|---|---|
| DE | 60020302 | T2 | 3/2006 |
| DE | 102017103628 | A1 | 8/2017 |
| EP | 1568864 | A1 | 8/2005 |
| WO | 9325998 | A1 | 12/1993 |
| WO | 2008127465 | A1 | 10/2008 |

* cited by examiner

METHODS AND SYSTEMS FOR AN EXHAUST TUNING VALVE

FIELD

The present description relates generally to adjusting a position of an exhaust tuning valve based on an identified driver behavior.

BACKGROUND/SUMMARY

The combustion process and firing of engine cylinders can introduce noise. In some examples, the combustion process generates acoustic effects through the exhaust system and tailpipe. A common approach to dampening engine noise is to use a muffler. However, a muffler may not dampen engine noise over a full range of engine operating conditions. Additionally, there may be instances where more noise is desired.

Other examples of addressing exhaust noise include active exhaust valve systems. One example approach is shown by Held et al. in U.S. Patent Publication number 20040226537. Therein, a characteristic map is triggered based on a current engine speed, engine load, and transmission gear engaged. The characteristic map may define an exhaust flap opening to adjust the exhaust noise to be selectively increased or muffled. For example, if the characteristic map is a racecar operation, which corresponds to high engine speeds and high load, then the exhaust flap may be opened relatively more to increase exhaust sounds through the exhaust system compared to a less aggressive operation such as a street vehicle operation. If the characteristic map is street vehicle operation, which corresponds to low engine speeds and low load, then the exhaust tuning valve may be relatively more closed to muffle exhaust sounds through the exhaust system.

However, the inventors have identified some issues with the approaches described above. For example, the inputs monitored therein may be insufficient to accurately characterize a current driving behavior as street operation or racecar operation. Thus, a vehicle operator may be forced to select an operating mode to realize a desired exhaust sound while driving. This may be cumbersome to the vehicle operator. Additionally, the inputs monitored in the reference may be insufficient to fully characterize aggressive and defensive driving. This may lead to customer dissatisfaction as noises may be increased when in fact the customer desires lower engine output noise.

In one example, the issues described above may be addressed by a method for adjusting a position of an exhaust tuning valve arranged in an exhaust passage based on a steering wheel input. In this way, an upcoming maneuver may be inferred and a desired exhaust sound corresponding to a characteristic map associated with the steering wheel input may be achieved.

As one example, inputs monitored may include longitudinal acceleration, lateral acceleration, yaw rate, throttle position, braking force, pitch angle, roll angle, and steering wheel angle may be used to classify and recognize driver behaviors to manage engine sound with maps that index with the monitored inputs. By doing this, driving events may be classified into different longitudinal and lateral events, such as defensive acceleration, sporty acceleration, defensive turn, and sporty turn.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
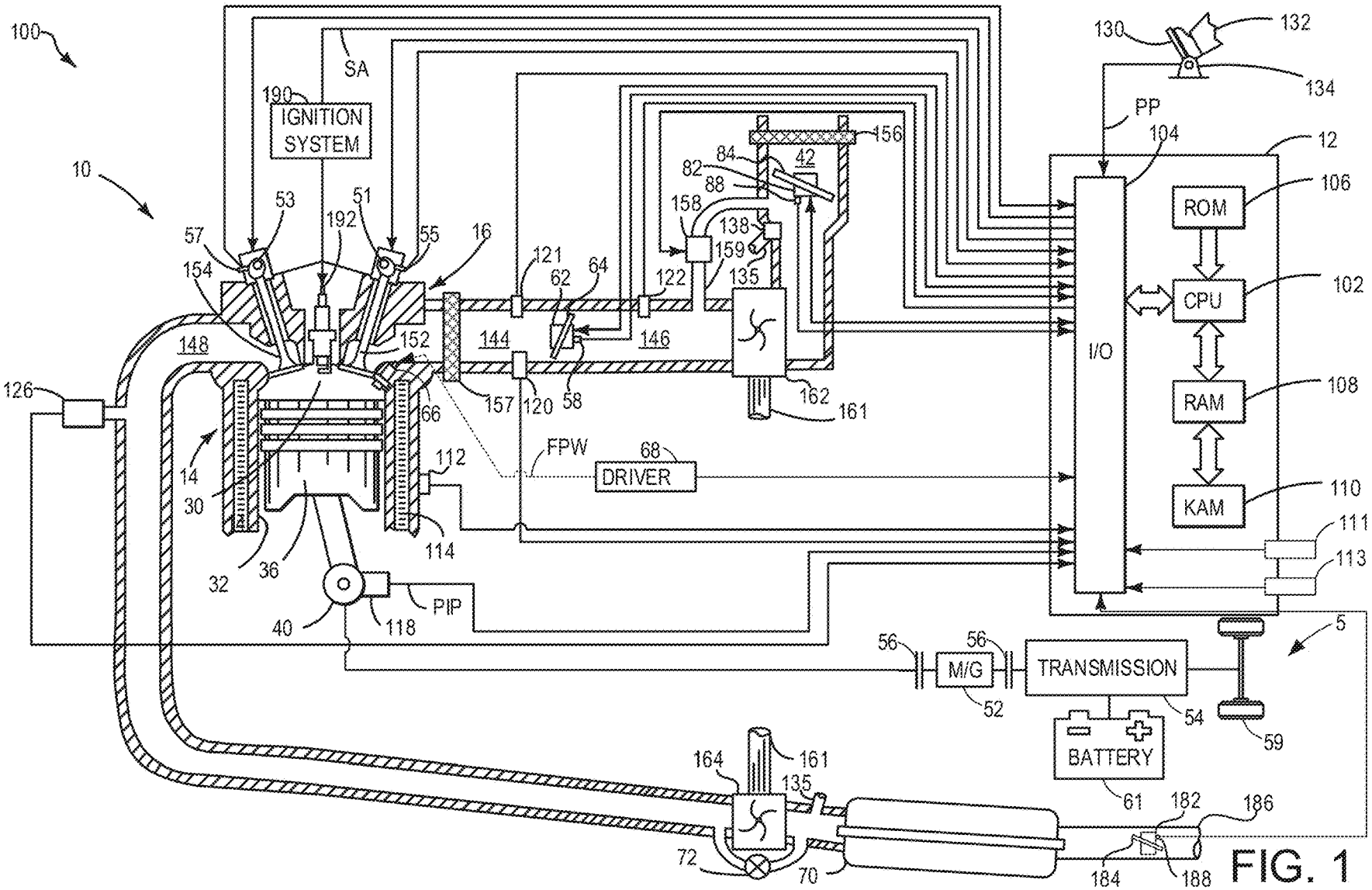
FIG. 1 illustrates a schematic of an engine included in a hybrid vehicle.
Figure 2:
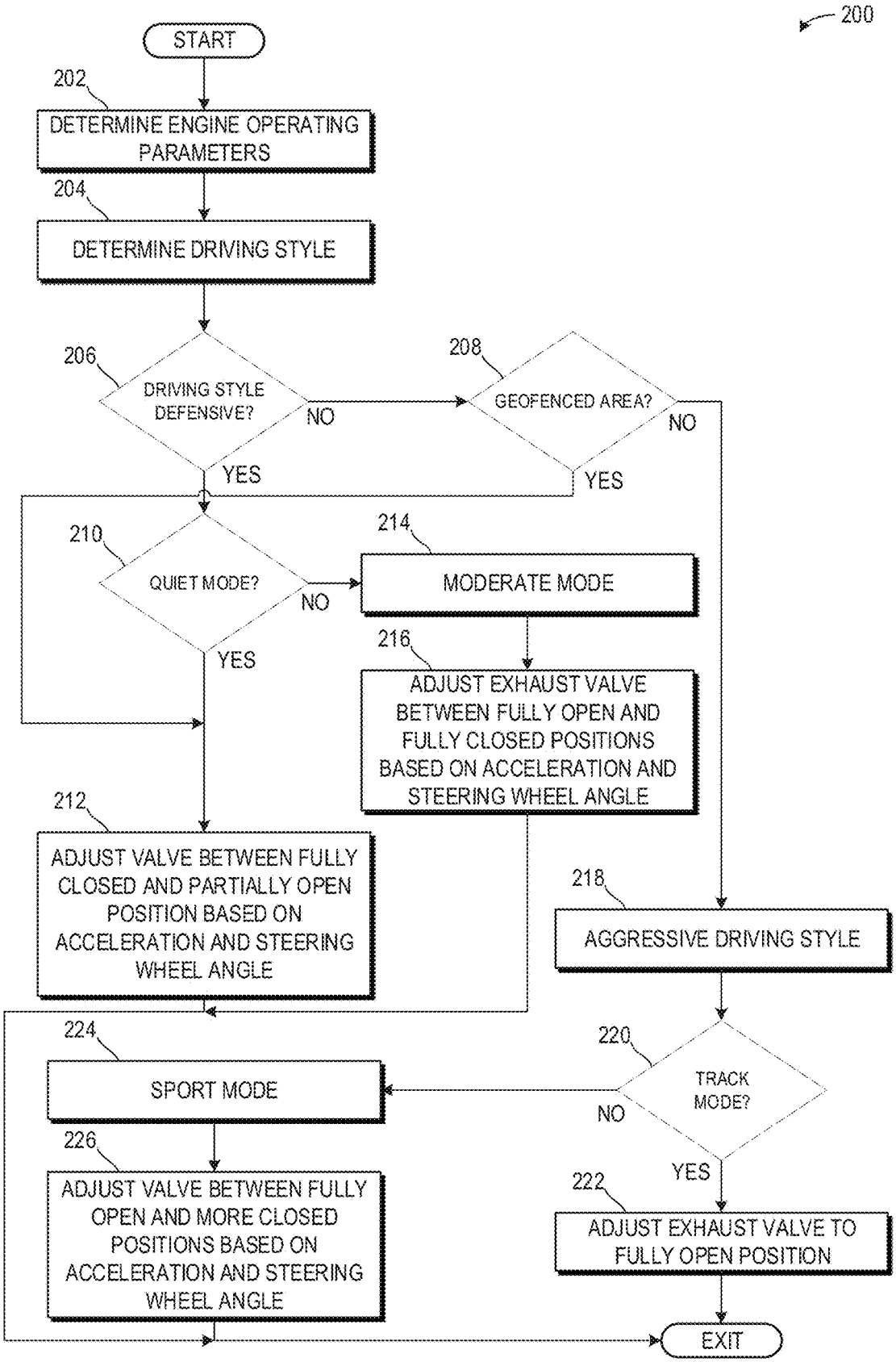
FIG. 2 illustrates a method for classifying driving behavior for selecting a characteristic noise map.
Figure 3A:
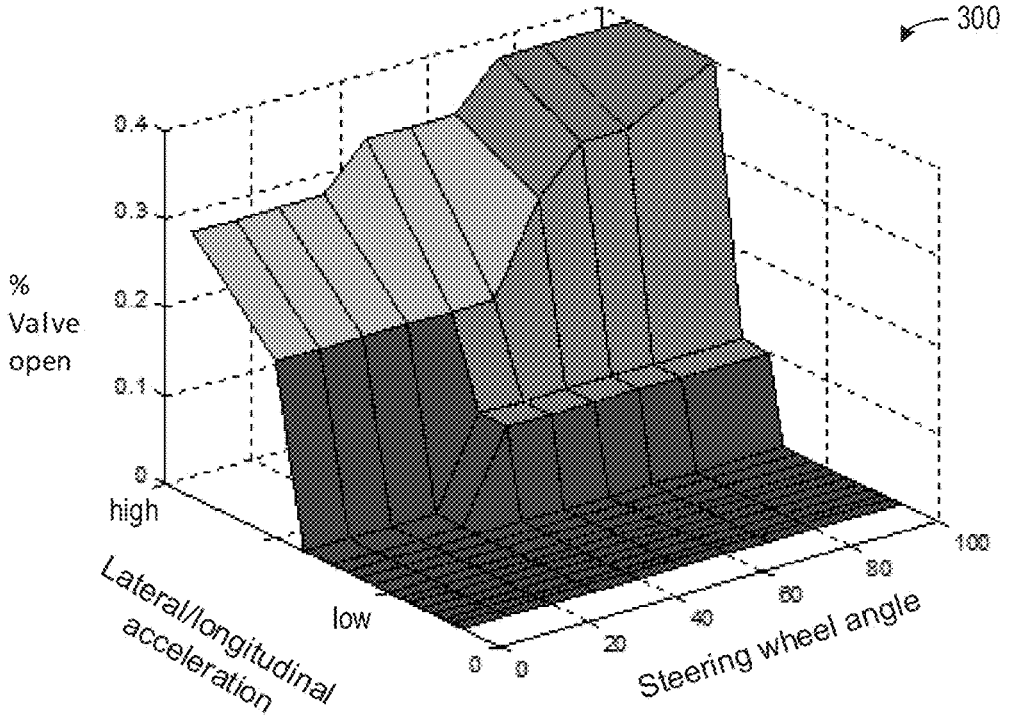
FIGS. 3A and 3B illustrate noise maps for defensive driving styles.
Figure 3B:
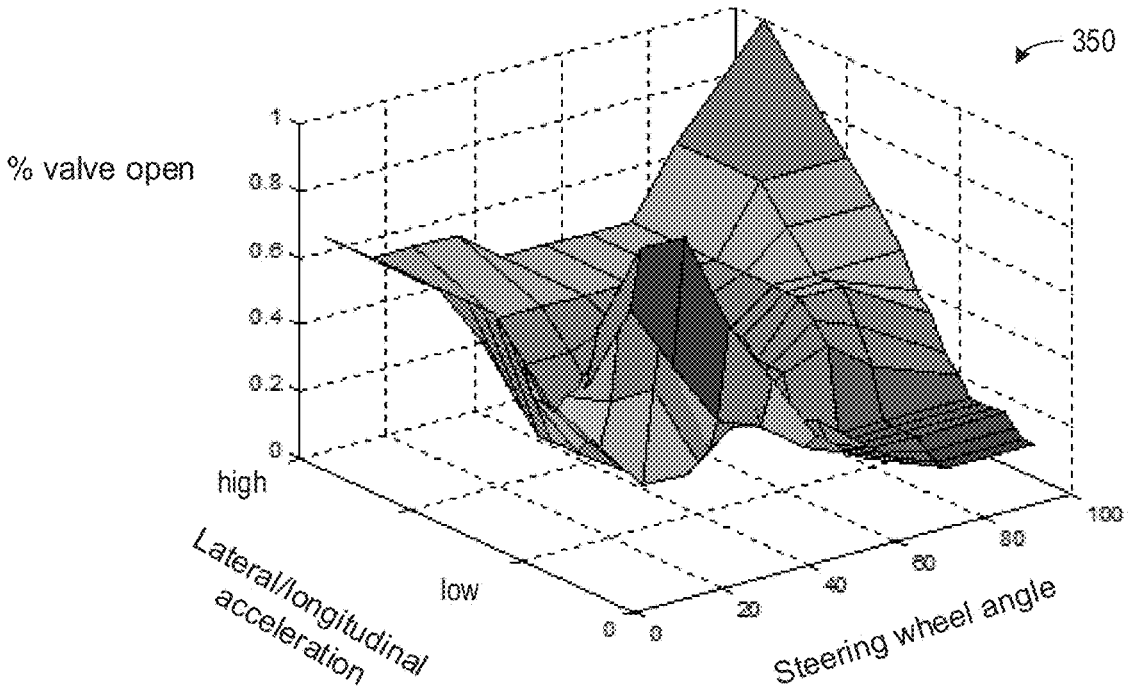
Figure 4A:
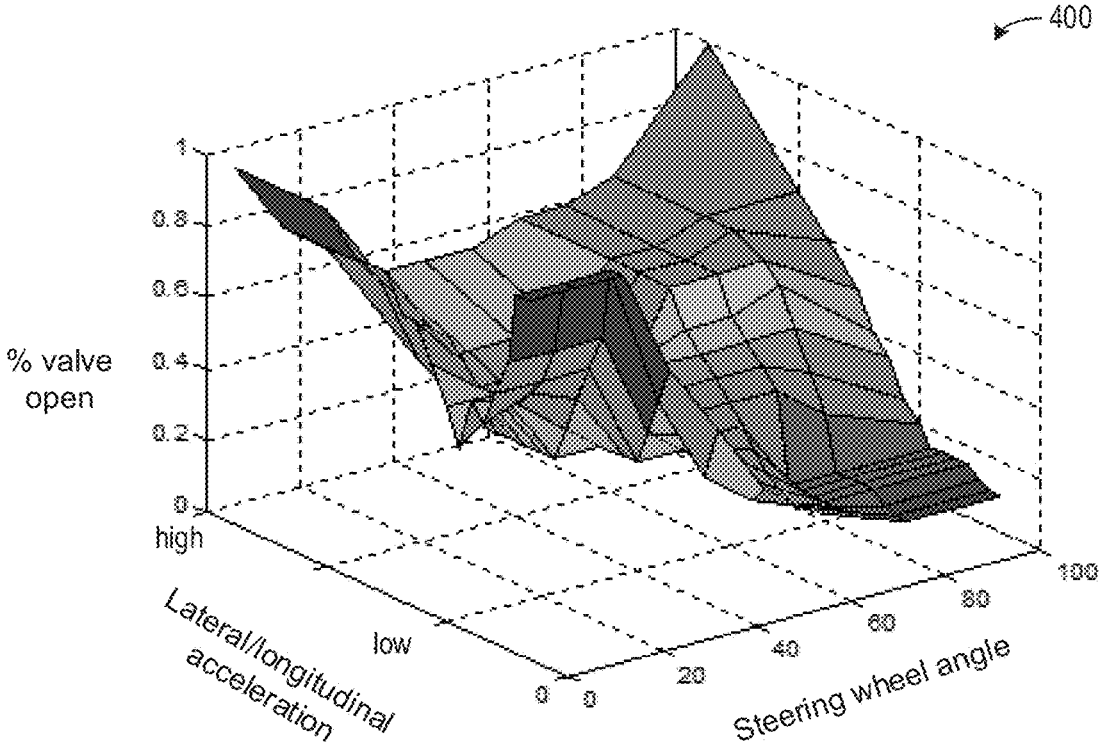
FIGS. 4A and 4B illustrate noise maps for aggressive driving styles.
Figure 4B:
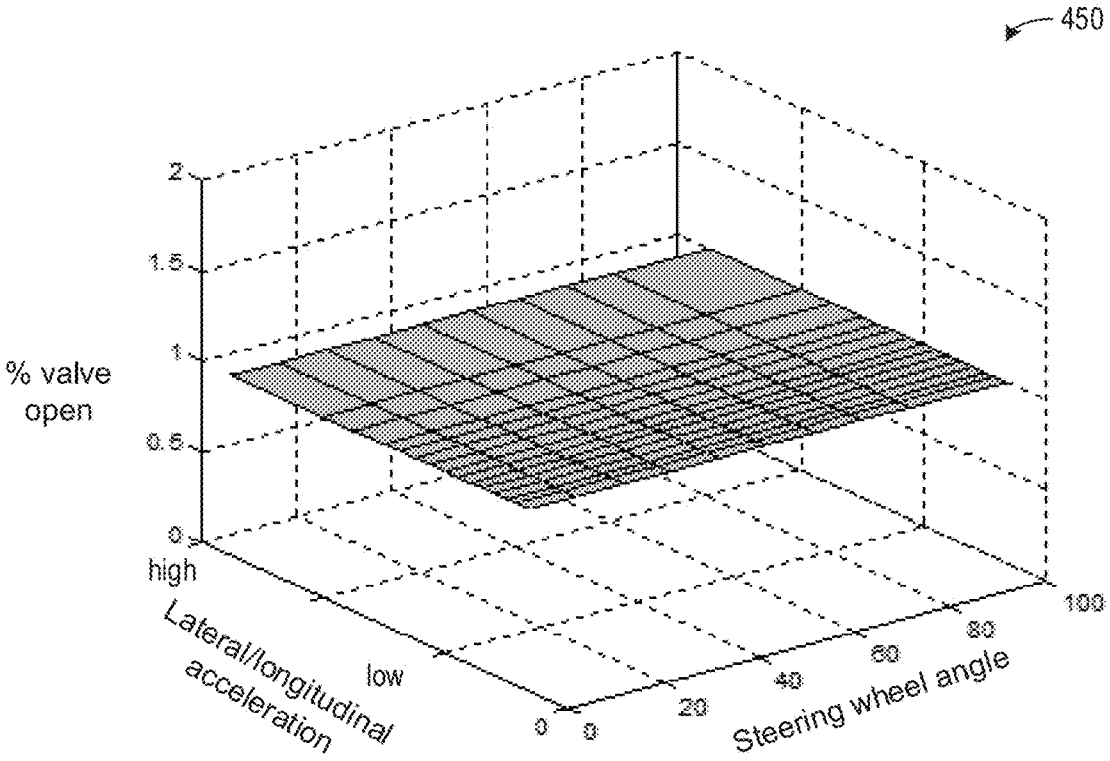
Figure 5:
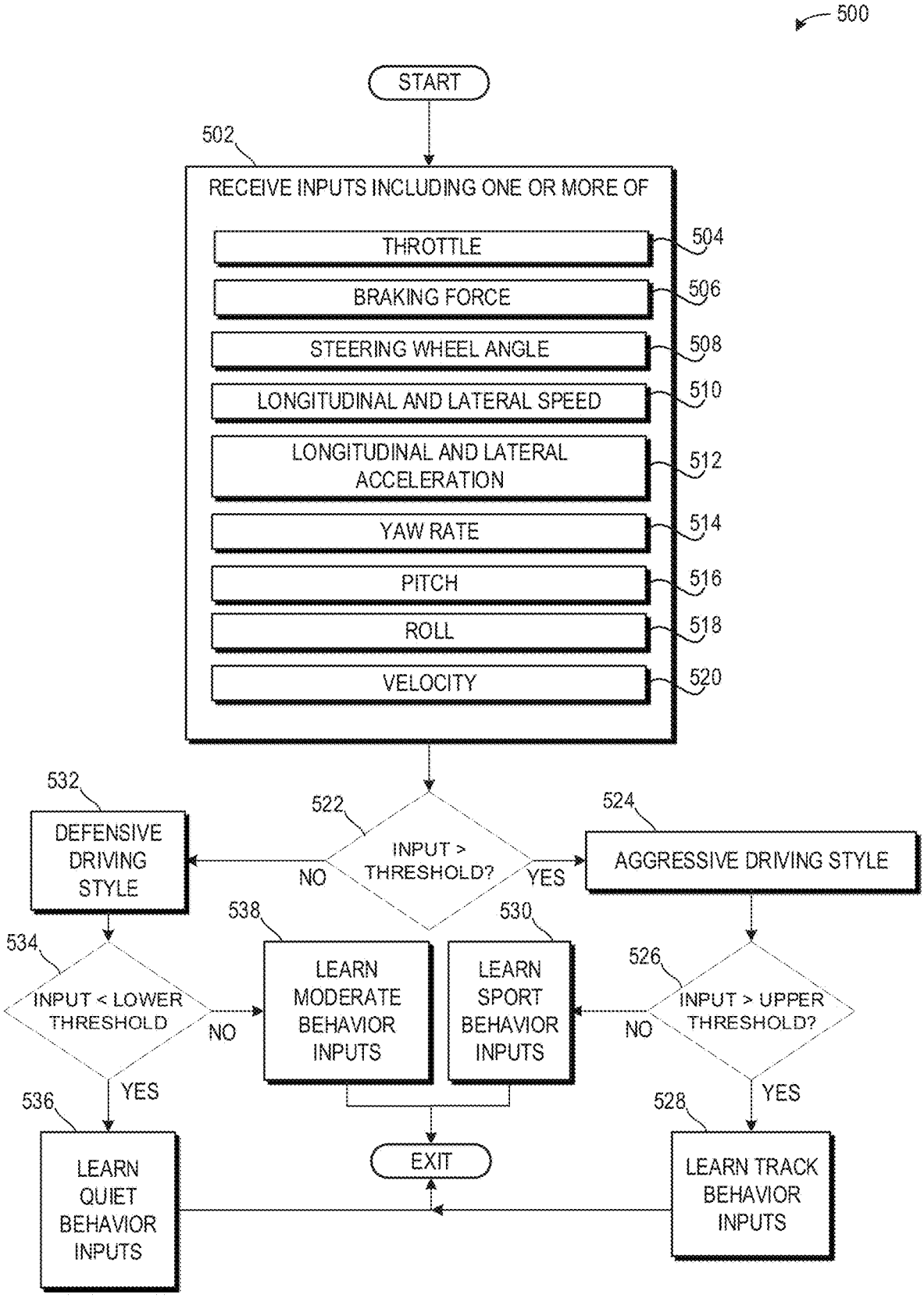
FIG. 5 illustrates a method for receiving a plurality of inputs and determining a current driving behavior.
Figure 6:
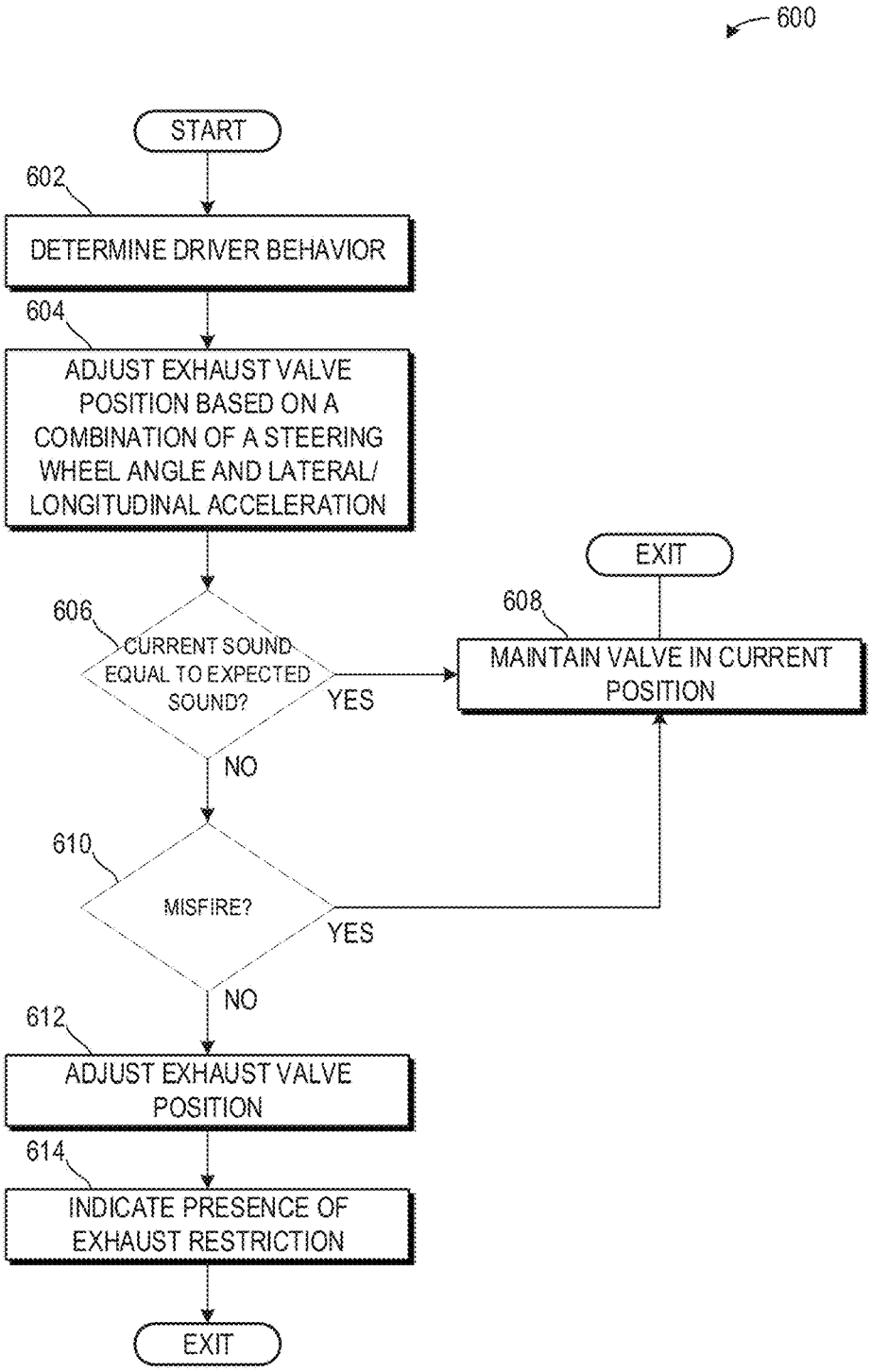
FIG. 6 illustrates a method for indicating an increase in exhaust backpressure due to a restricted aftertreatment device.

The following description relates to systems and methods for adjusting an exhaust tuning valve. The exhaust tuning valve may be arranged in an exhaust system configured to receive exhaust gases from an engine, as shown in FIG. 1. The exhaust tuning valve may be adjusted via data stored in an engine sound map. The engine sound map may be selected based on a driving style along with reception of one or more inputs associated and/or indexed with the engine sound map, as shown in the method of FIG. 2. FIG. 5 illustrates a method for learning a driving behavior via a plurality of inputs. Engine sound maps corresponding to defensive driving behaviors are shown in FIGS. 3A and 3B. Therein, the exhaust tuning valve may be adjusted to muffle engine sounds. Engine sound maps corresponding to aggressive driving behaviors are shown in FIGS. 4A and 4B. Therein, the exhaust tuning valve may be adjusted to increase engine sounds. In one example, the exhaust tuning valve may be maintained in more closed positions during defensive driving behaviors while the exhaust tuning valve may be maintained in more open or fully open positions during aggressive driving behaviors. FIG. 6 illustrates a method for determining a presence of an exhaust restriction in response to adjusting the exhaust tuning valve to a more open position than an expected position mapped in the engine sound map. For example, if the exhaust tuning valve is adjusted to a position more open than an expected position mapped in the engine sound map to produce a desired sound, then a restriction may be present in the exhaust system, which may increase an exhaust backpressure to a pressure higher than expected. In one example, this may be due to a partially restricted catalyst.

FIG. 1 shows an example configuration with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

FIG. 1 depicts an engine system 100 for a vehicle. The vehicle may be an on-road vehicle having drive wheels which contact a road surface. Engine system 100 includes engine 10 which comprises a plurality of cylinders. FIG. 1 describes one such cylinder or combustion chamber in detail. The various components of engine 10 may be controlled by electronic engine controller 12, which may be included in a vehicle control system.

Engine 10 includes a cylinder block 14 including at least one cylinder bore, and a cylinder head 16 including intake valves 152 and exhaust valves 154. In other examples, the cylinder head 16 may include one or more intake ports and/or exhaust ports in examples where the engine 10 is configured as a two-stroke engine. The cylinder block 14 includes cylinder walls 32 with piston 36 positioned therein and connected to crankshaft 40. Thus, when coupled together, the cylinder head 16 and cylinder block 14 may form one or more combustion chambers. As such, the combustion chamber 30 volume is adjusted based on an oscillation of the piston 36. Combustion chamber 30 may also be referred to herein as cylinder 30. The combustion chamber 30 is shown communicating with intake manifold 144 and exhaust manifold 148 via respective intake valves 152 and exhaust valves 154. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57. Thus, when the valves 152 and 154 are closed, the combustion chamber 30 and cylinder bore may be fluidly sealed, such that gases may not enter or leave the combustion chamber 30.

Combustion chamber 30 may be formed by the cylinder walls 32 of cylinder block 14, piston 36, and cylinder head 16. Cylinder block 14 may include the cylinder walls 32, piston 36, crankshaft 40, etc. Cylinder head 16 may include one or more fuel injectors such as fuel injector 66, one or more intake valves 152, and one or more exhaust valves such as exhaust valves 154. The cylinder head 16 may be coupled to the cylinder block 14 via fasteners, such as bolts and/or screws. In particular, when coupled, the cylinder block 14 and cylinder head 16 may be in sealing contact with one another via a gasket, and as such the cylinder block 14 and cylinder head 16 may seal the combustion chamber 30, such that gases may only flow into and/or out of the combustion chamber 30 via intake manifold 144 when intake valves 152 are opened, and/or via exhaust manifold 148 when exhaust valves 154 are opened. In some examples, only one intake valve and one exhaust valve may be included for each combustion chamber 30. However, in other examples, more than one intake valve and/or more than one exhaust valve may be included in each combustion chamber 30 of engine 10.

In some examples, each cylinder of engine 10 may include a spark plug 192 for initiating combustion. Ignition system 190 can provide an ignition spark to cylinder 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

Fuel injector 66 may be positioned to inject fuel directly into combustion chamber 30, which is known to those skilled in the art as direct injection. Fuel injector 66 delivers liquid fuel in proportion to the pulse width of signal FPW from controller 12. Fuel is delivered to fuel injector 66 by a fuel system (not shown) including a fuel tank, fuel pump, and fuel rail. Fuel injector 66 is supplied operating current from driver 68 which responds to controller 12. In some examples, the engine 10 may be a gasoline engine, and the fuel tank may include gasoline, which may be injected by injector 66 into the combustion chamber 30. However, in other examples, the engine 10 may be a diesel engine, and the fuel tank may include diesel fuel, which may be injected by injector 66 into the combustion chamber. Further, in such examples where the engine 10 is configured as a diesel engine, the engine 10 may include a glow plug to initiate combustion in the combustion chamber 30.

Intake manifold 144 is shown communicating with throttle 62 which adjusts a position of throttle plate 64 to control airflow to engine cylinder 30. This may include controlling airflow of boosted air from intake boost chamber 146. In some embodiments, throttle 62 may be omitted and airflow to the engine may be controlled via a single air intake system throttle (AIS throttle) 82 coupled to air intake passage 42 and located upstream of the intake boost chamber 146. In yet further examples, AIS throttle 82 may be omitted and airflow to the engine may be controlled with the throttle 62.

In some embodiments, engine 10 is configured to provide exhaust gas recirculation, or EGR. When included, EGR may be provided as high-pressure EGR and/or low-pressure EGR. In examples where the engine 10 includes low-pressure EGR, the low-pressure EGR may be provided via EGR passage 135 and EGR valve 138 to the engine air intake system at a position downstream of air intake system (AIS) throttle 82 and upstream of compressor 162 from a location in the exhaust system downstream of turbine 164. EGR may be drawn from the exhaust system to the intake air system when there is a pressure differential to drive the flow. A pressure differential can be created by partially closing AIS throttle 82. Throttle plate 84 controls pressure at the inlet to compressor 162. The AIS may be electrically controlled and its position may be adjusted based on optional position sensor 88.

Ambient air is drawn into combustion chamber 30 via intake passage 42, which includes air filter 156. Thus, air first enters the intake passage 42 through air filter 156. Compressor 162 then draws air from air intake passage 42 to supply boost chamber 146 with compressed air via a compressor outlet tube (not shown in FIG. 1). In some examples, air intake passage 42 may include an air box (not shown) with a filter. In one example, compressor 162 may be a turbocharger, where power to the compressor 162 is drawn from the flow of exhaust gases through turbine 164. Specifically, exhaust gases may spin turbine 164 which is coupled to compressor 162 via shaft 161. A wastegate 72 allows exhaust gases to bypass turbine 164 so that boost pressure can be controlled under varying operating conditions. Wastegate 72 may be closed (or an opening of the wastegate may be decreased) in response to increased boost demand, such as during an operator pedal tip-in. By closing the wastegate, exhaust pressures upstream of the turbine can be increased, raising turbine speed and peak power output. This allows boost pressure to be raised. Additionally, the wastegate can be moved toward the closed position to maintain desired boost pressure when the compressor recirculation valve is partially open. In another example, wastegate 72 may be opened (or an opening of the wastegate may be increased) in response to decreased boost demand, such as during an operator pedal tip-out. By opening the wastegate, exhaust pressures can be reduced, reducing turbine speed and turbine power. This allows boost pressure to be lowered.

However, in alternate embodiments, the compressor 162 may be a supercharger, where power to the compressor 162 is drawn from the crankshaft 40. Thus, the compressor 162 may be coupled to the crankshaft 40 via a mechanical linkage such as a belt. As such, a portion of the rotational energy output by the crankshaft 40, may be transferred to the compressor 162 for powering the compressor 162.

Compressor recirculation valve 158 (CRV) may be provided in a compressor recirculation path 159 around compressor 162 so that air may move from the compressor outlet to the compressor inlet so as to reduce a pressure that may develop across compressor 162. A charge air cooler 157 may be positioned in boost chamber 146, downstream of compressor 162, for cooling the boosted aircharge delivered to the engine intake. However, in other examples as shown in FIG. 1, the charge air cooler 157 may be positioned downstream of the electronic throttle 62 in an intake manifold 144. In some examples, the charge air cooler 157 may be an air to air charge air cooler. However, in other examples, the charge air cooler 157 may be a liquid to air cooler.

In the depicted example, compressor recirculation path 159 is configured to recirculate cooled compressed air from upstream of charge air cooler 157 to the compressor inlet. In alternate examples, compressor recirculation path 159 may be configured to recirculate compressed air from downstream of the compressor and downstream of charge air cooler 157 to the compressor inlet. CRV 158 may be opened and closed via an electric signal from controller 12. CRV 158 may be configured as a three-state valve having a default semi-open position from which it can be moved to a fully-open position or a fully-closed position.

The exhaust passage 148 further comprises an exhaust tuning valve 184 and an exhaust tuning valve actuator 182. The exhaust tuning valve 184 may be actuated via a command, such as an electrical pulse, delivered to the exhaust tuning valve actuator 182 to adjust an exhaust backpressure. By adjusting the exhaust backpressure, a noise emanating from the tailpipe 186 may also be adjusted. For example, adjusting the noise from the tailpipe may include adjusting an actuator 186 of the exhaust tuning valve 184 based on feedback regarding a position of the exhaust tuning valve 184 from position sensor 188. In this way, the exhaust tuning valve 184 may be adjusted to a more open position to increase the noise or to a more closed position to decrease the noise. Adjusting the exhaust tuning valve 184 will be described in greater detail below with respect to FIG. 2 through FIG. 5.

Universal Exhaust Gas Oxygen (UEGO) sensor 126 is shown coupled to exhaust manifold 148 upstream of emission control device 70. Alternatively, a two-state exhaust gas oxygen sensor may be substituted for UEGO sensor 126. Emission control device 70 may include multiple catalyst bricks, in one example. In another example, multiple emission control devices, each with multiple bricks, can be used. While the depicted example shows UEGO sensor 126 upstream of turbine 164, it will be appreciated that in alternate embodiments, UEGO sensor may be positioned in the exhaust manifold downstream of turbine 164 and upstream of emission control device 70. Additionally or alternatively, the emission control device 70 may comprise a diesel oxidation catalyst (DOC) and/or a diesel cold-start catalyst, a particulate filter, a three-way catalyst, a $NO_x$ trap, selective catalytic reduction device, and combinations thereof. In some examples, a sensor may be arranged upstream or downstream of the emission control device 70, wherein the sensor may be configured to diagnose a condition of the emission control device 70.

Controller 12 is shown in FIG. 1 as a microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an input device 130 for sensing input device pedal position (PP) adjusted by a vehicle operator 132; a knock sensor for determining ignition of end gases (not shown); a measurement of engine manifold pressure (MAP) from pressure sensor 121 coupled to intake manifold 144; a measurement of boost pressure from pressure sensor 122 coupled to boost chamber 146; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. In a preferred aspect of the present description, Hall effect sensor 118 produces a predetermined number of equally spaced pulses every revolution of the crankshaft from which engine speed (RPM) can be determined. The input device 130 may comprise an accelerator pedal and/or a brake pedal. As such, output from the position sensor 134 may be used to determine the position of the accelerator pedal and/or brake pedal of the input device 130, and therefore determine a desired engine torque. Thus, a desired engine torque as requested by the vehicle operator 132 may be estimated based on the pedal position of the input device 130.

The controller 12 may be further coupled to a two-axis accelerometer 111 and an inertial measurement unit (IMU) sensor 113. As will be described in greater detail below, feedback from the accelerometer 111 and the IMU sensor 113 may provide data for a plurality of inputs including one or more of a steering wheel angle, lateral acceleration, longitudinal acceleration, lateral speed, longitudinal speed, and the like for adjusting a position of the exhaust tuning valve 184. Additionally, the plurality of inputs may be used to automatically determine a driver behavior without a vehicle operator selecting their behavior. As such, vehicle maneuvers may be classified as defensive or aggressive behaviors, which may affect a position to which the exhaust tuning valve 184 is adjusted in response to the input. Thus, for the same input value, the exhaust tuning valve 184 may be in a first position for a defensive behavior and a second position, different than the first position, for an aggressive behavior.

In some examples, vehicle 5 may be a hybrid vehicle with multiple sources of torque available to one or more vehicle wheels 59. In other examples, vehicle 5 is a conventional vehicle with only an engine, or an electric vehicle with only electric machine(s). In the example shown, vehicle 5 includes engine 10 and an electric machine 52. Electric machine 52 may be a motor or a motor/generator. Crankshaft 40 of engine 10 and electric machine 52 are connected via a transmission 54 to vehicle wheels 59 when one or more clutches 56 are engaged. In the depicted example, a first clutch 56 is provided between crankshaft 40 and electric machine 52, and a second clutch 56 is provided between electric machine 52 and transmission 54. Controller 12 may send a signal to an actuator of each clutch 56 to engage or disengage the clutch, so as to connect or disconnect crankshaft 40 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 61 to provide torque to vehicle wheels 59. Electric machine 52 may also be operated as a generator to provide electrical power to charge battery 61, for example during a braking operation.

The controller 12 receives signals from the various sensors of FIG. 1 and employs the various actuators of FIG. 1 to adjust engine operation based on the received signals and instructions stored on a memory of the controller. For example, adjusting operation of the electric machine 52 may occur based on feedback from ECT sensor 112. As will be described in greater detail below, the engine 10 and electric machine 52 may be adjusted such that their operations may be delayed based on one or more of a powertrain temperature, which may be estimated based on feedback from ECT sensor 112, and a distance between an intended destination and an electric-only operation range.

Turning now to FIG. 2, it shows a method 200 for adjusting a position of an exhaust tuning valve, such as the exhaust tuning valve 184 of FIG. 1, to adjust an exhaust noise level based on an identified driving style. Instructions for carrying out method 200 and the rest of the methods included herein may be executed by a controller based on instructions stored on a memory of the controller and in conjunction with signals received from sensors of the engine system, such as the sensors described above with reference to FIG. 1. The controller may employ engine actuators of the engine system to adjust engine operation, according to the methods described below. For example, the controller may signal to an actuator of the exhaust tuning valve to adjust a position of the exhaust tuning valve in response to receiving an input during a determined driver behavior to adjust an engine noise.

The method 200 begins at 202, which includes determining, estimating, and/or measuring current engine operating parameters. Current engine operating parameters may include, but are not limited to, one or more of manifold vacuum, throttle position, engine speed, engine load, accelerator pedal position, engine temperature, and air/fuel ratio.

The method 200 proceeds to 204, which comprises determining a driving style and/or a driving behavior. In one example, the driving behavior is classified via supervised, machine learning receiving and/or estimating a plurality of inputs including longitudinal and lateral acceleration and steering wheel angle. Classifying a driving behavior and learning input values associated with the driving behavior is described in further detail with respect to FIG. 5. By classifying the driving behavior, the method 200 may automatically determine the driving behavior, resulting in reduced driver distractions and an enhanced driving experience as the driver is not forced to change modes multiple times to produce desired engine sounds as will be discussed in further detail below.

The method 200 proceeds to 206, which comprises determining if the driving style is defensive. The driving style may be based on a driver history and/or a plurality of inputs received during a current drive cycle. The plurality of inputs may include a throttle position, braking force, longitudinal speed, lateral speed, longitudinal acceleration, lateral acceleration, steering wheel angle, yaw rate, pitch, and roll. In one example longitudinal and lateral acceleration, along with steering wheel angle, may be the primary factors when determining the driving style. The longitudinal speed and acceleration may be measured along a longitudinal axis of the vehicle whereas the lateral speed and acceleration may be measured along a lateral axis of the vehicle, perpendicular to the longitudinal axis.

If the driving style is not defensive, then the method 200 proceeds to 208 to determine if the vehicle is arranged in a geofenced area. A geofenced area may correspond to a neighborhood, a school, an urban area (e.g., a downtown metropolis), a park, a hospital, a church, and the like. A vehicle may be in a geofenced area if the vehicle is within a threshold radius of the geofenced area (e.g., with 1 kilometer). The geofenced areas may desire reduced noises from vehicles during certain times of the day or at all times of the day. A vehicle location may be determined based on feedback from a navigation system or other location device (e.g., cell phone).

If the driving style is defensive, then the method 200 proceeds to 210 to determine if the driving style corresponds to a quiet mode. The quiet mode may correspond to when the vehicle is in a geofenced area. Additionally or alternatively, the quiet mode behavior may correspond to low steering wheel angles and low longitudinal and lateral accelerations. For example, if a lateral acceleration is less than a lower threshold lateral acceleration, which is less than the threshold lateral acceleration, then a sub-category of the current defensive driving style may include where the driving style corresponds to a quiet mode. As such, the vehicle operator may not desire producing high amount of engine noise as a courtesy to their surrounding environment.

If the quiet mode matches the current driving style or if the vehicle is in a geofenced area, then the method 200 proceeds to 212 to adjust the exhaust tuning valve between partially open and fully closed positions based on longitudinal and lateral accelerations and the steering wheel angle. In one example, the exhaust valve is adjusted between a 1% open and a 50% open position. Additionally or alternatively, the exhaust valve is adjusted between a 5 to 45% open position. In one example, the exhaust valve is adjusted between a 10 to 40% open position. In one example, a fully closed position corresponds to a 0% opening and a fully open position corresponds to a 100% opening. The fully closed position may increase exhaust backpressure to a highest value, where noise is maximally muffled. The fully open position may decrease exhaust backpressure to a lowest value, where noise is minimally muffled. In one example, the exhaust valve is adjust based on engine sound map 300 of FIG. 3A.

If the quiet mode does not match the current driving style, then the method 200 proceeds to 214, which includes the driving style matching a moderate mode. The method 200 proceeds to 216, which includes adjusting the exhaust valve between the more closed position and a fully open position. The moderate mode may provide an increase in exhaust sound during a vehicle start-up, revving in neutral, and while driving relative to the quiet mode. For example, for a steering wheel angle between 60 and 80 degrees in the moderate mode, the exhaust valve may be 60% open while the exhaust valve is 10% open for the same steering wheel angle in the quiet mode. In one example, the exhaust valve is fully opened when the steering wheel angle is 100 degrees and the lateral or longitudinal acceleration is relatively high in the moderate mode, whereas the exhaust valve is 40% open in the quiet mode under identical conditions.

Returning to 208, if the driving style is not defensive and the vehicle is not arranged in a geofenced area, then the method 200 proceeds to 218, which includes the driving style being aggressive. The method 200 proceeds to 220 to determine if the aggressive driving style matches a track mode. In one example, the track mode may be determined via a vehicle operator selection, a vehicle location, and/or the driver behavior. For example, in the absence of the vehicle operator selecting the track mode, the method 200 may determine a track mode is desired in response to relatively high longitudinal and lateral accelerations and relatively high steering wheel angles being greater than upper threshold, as described in greater detail below with respect to FIG. 5. The track mode may comprise where the exhaust valve is adjusted to a fully open position, at 222, during engine operation to produce a highest engine sound during all engine operating parameters. Exhaust backpressure may be reduced to a lowest value. NVH during the track mode may be higher than NVH in the other modes (e.g., sport mode, moderate mode, and quiet mode). As such, the exhaust valve is not moved out of the fully open position in the track mode, in one example.

If the aggressive driving style is not a track mode driving style, then the method 200 proceeds to 224, which includes the driving style being in a sport mode. The method 200 proceeds to 226, which includes adjusting the exhaust valve between a fully open position and a more open position based on longitudinal and lateral accelerations and a steering wheel angle. It will be appreciated that for the same steering wheel angle and lateral and longitudinal accelerations, the exhaust valve in the sport mode may be in a more open position compared to the quiet mode and the moderate mode.

In some examples of the method 200, upcoming maneuvers may be predicted based on the selected driving style so that engine sounds during the upcoming maneuver may more closely match a sound desired by the vehicle operator. For example, if the driving style is a sport driving style and it is predicted than an upcoming vehicle maneuver may include a high steering wheel angle and a high lateral acceleration, then the exhaust valve may be preemptively moved to a more open or fully open position in anticipation of the maneuver. If the steering wheel is being turned quickly such that a high steering wheel angle is anticipated as a result of a steering wheel input angle rate of change, then the exhaust tuning valve may be moved to a more open position to increase engine sound. In this way, the faster a steering wheel is adjusted away from center, then the behavior may be considered more aggressive, and the exhaust tuning valve may be adjusted to a more open position.

Turning now to FIGS. 3A through 4B, they show engine noise maps for the quiet mode, the moderate mode, the sport mode, and the track mode, respectively. The engine noise maps illustrate an adjustment of an exhaust tuning valve in response to one or more inputs including longitudinal accelerations, lateral accelerations, and steering wheel angle. The exhaust tuning valve may be adjusted to a fully closed position, a fully open position, or to a position therebetween. The fully closed position may correspond to a position of the exhaust tuning valve where an exhaust backpressure is the highest. Thus, the fully open position may correspond to a position of the exhaust tuning valve where the exhaust backpressure is the lowest. In this way, the fully closed position may impede exhaust gas flow more than the fully open position. In one example, exhaust gas may still flow past the exhaust tuning valve in the fully closed position, however, its flow may be impeded, resulting in high levels of exhaust backpressure. Herein, the fully closed position is described as a 0% open position and the fully open position is described as a 100% open position. As such, a 30% open position more closely resembles the fully closed position (e.g., 0% open position) more than the 100% open position.

Turning now to FIG. 3A, it shows an example quiet mode map 300 illustrating example exhaust tuning valve positions based on various lateral and longitudinal accelerations and steering wheel angles. The lateral acceleration may correspond to a rotation around a center of a corner along with a horizontal acceleration. The sum of these two components, which may be estimated via feedback from a two-axis accelerometer, such as accelerometer 111 of FIG. 1, and an IMU sensor such as IMU sensor 113 of FIG. 1, may be equal to the lateral acceleration. Additionally or alternatively, the lateral acceleration may include a yaw rate in its determination. Longitudinal acceleration may correspond to a straight-line acceleration of the vehicle parallel to a longitudinal axis of the vehicle. The steering wheel angle may be a measure of a steering wheel position angle and a rate of turn. The steering wheel angle may increase as the wheel is turned more in a clockwise or counterclockwise direction away from a center position, wherein the center position of the steering wheel directs the vehicle to drive in a direction parallel to the longitudinal axis.

As shown, a highest opening of the exhaust tuning valve during the quiet mode occurs at a highest steering wheel angle and a highest lateral or longitudinal acceleration, wherein the highest opening of the exhaust tuning valve is 40%. Along the highest longitudinal or lateral acceleration value, the exhaust tuning valve open percentage is adjusted between 30 and 40%, wherein 30% corresponds to a steering wheel angle of 0 degrees and 40% corresponds to a steering wheel angle of 100 degrees. Along the highest steering wheel angle (e.g., 100 degrees), the exhaust tuning valve open percentage may be adjusted between 0 and 40%, wherein the exhaust tuning valve is fully closed (e.g., 0% open) at a relatively low lateral or longitudinal acceleration and partially open to 40% at the highest lateral or longitudinal acceleration.

Turning now to FIG. 3B, it shows an example moderate mode engine noise map 350 illustrating example exhaust tuning valve positions relative to lateral accelerations, longitudinal accelerations, and steering wheel angles. As will be described herein, for similar inputs under similar conditions regarding the steering wheel angle, lateral acceleration, and longitudinal acceleration, the exhaust tuning valve position is in a more open position relative to the position in the quiet mode.

For example, along the highest longitudinal or lateral acceleration value, the exhaust tuning valve open percentage is adjusted between 40 to 100%, wherein the exhaust tuning valve is 40% open at steering wheel angles of 40 to 60 degrees and 100% open at a steering wheel angle of 100 degrees. Along the highest steering wheel angle of 100 degrees, the exhaust tuning valve open percentage is adjusted between 10 and 100%, wherein the exhaust tuning valve is 10% open when the lateral or longitudinal acceleration is relatively low and 100% open when the lateral or longitudinal acceleration is relatively high. As such, more noise is produced in the moderate mode relative to the quiet mode due to the exhaust tuning valve being in a more open position for similar steering wheel angle, lateral acceleration, and longitudinal acceleration inputs.

Turning now to FIG. 4A, it shows an example sport mode engine noise map 400 illustrating example exhaust tuning valve positions relative to lateral accelerations, longitudinal accelerations, and steering wheel angles. As will be described herein, for similar inputs for similar conditions regarding the steering wheel angle, lateral acceleration, and longitudinal acceleration, the exhaust tuning valve position is in a more open position relative to the positions shown in the moderate mode shown in FIG. 3B and the quiet mode shown in FIG. 3A.

For example, along the highest longitudinal or lateral acceleration value, the exhaust tuning valve open percentage is adjusted between 50 to 100%, wherein the exhaust tuning valve is 50% open at steering wheel angles of 40 60 degrees and 100% open at a steering wheel angle of 100 degrees. As a further comparison point, the exhaust tuning valve is 90% open at a steering wheel angle of 0 degrees along the highest longitudinal or lateral acceleration value in the sport mode compared to a 70% opening in the moderate mode illustrated in FIG. 3B.

Along the highest steering wheel angle, the exhaust tuning valve open percentage is adjusted between 10 and 100%, wherein the exhaust tuning valve is 10% open when the lateral or longitudinal acceleration is relatively low and 100% open when the lateral or longitudinal acceleration is relatively high. As such, the operation of the exhaust tuning valve when the steering wheel angle is at 100 degrees in the sport mode is substantially similar to the operation of the exhaust tuning valve in the moderate mode at an identical steering wheel angle. However, for lower steering wheel angles, the sport mode is louder than the normal mode. For example, at a steering wheel angle of 60 degrees and a lateral or a longitudinal acceleration being relatively high, the exhaust tuning valve is 50% open in the sport mode and 40% open in the normal mode.

Turning now to FIG. 4B, it shows an example track mode engine sound map 450 illustrating example exhaust tuning valve positions relative to lateral accelerations, longitudinal accelerations, and steering wheel angles. For all values of the steering wheel angle, lateral acceleration, and longitudinal acceleration, the exhaust tuning valve position is 100% open. Thus, the track mode does not attempt to muffle engine sounds via the exhaust tuning valve. In this way, an engine sound is maximized during the track mode during all conditions and an exhaust tuning valve position is not adjusted based on the steering wheel angle, the lateral acceleration, or the longitudinal acceleration.

Turning now to FIG. 5, it shows a method 500 for classifying inputs received to characterize a vehicle driving behavior as aggressive or defensive behavior. The aggressive and defensive behaviors may be further sub-categorized into a track mode and a sport mode in the example of aggressive behavior and a moderate mode and a quiet mode in the example of defensive behavior. In one example, the method 500 uses feedback from a two-axis accelerometer (e.g., accelerometer 111 of FIG. 1) and an IMU sensor (e.g., IMU sensor 113 of FIG. 1) to provide data into a fuzzy logic system to classify a driver as aggressive or defensive, and to further sub-categorize the vehicle operator as described. The driver classification may be executed via supervised learning techniques such that engine sound maps may accurately predict a desired engine sound. In some examples, random forest or support vector machines may be the supervised learning technique. In this way, the method 500 may represent a method for learning a driving behavior for a single driver, wherein the learned driver behavior may be converted into an associated engine noise map via an algorithm.

The method 500 may learn a driving behavior for a plurality of drivers. In some examples, additionally or alternatively, threshold described with respect to FIG. 5 may be adjusted for different drivers. For example, if a first driver is typically a defensive style driver, then a threshold steering wheel angle for the first driver may be a lower value than a value of the threshold steering wheel angle for a second driver that is typically an aggressive driver. In this way, when the first driver desires a louder engine sound, a maneuver executed by the first, more defensive driver may be less aggressive than a maneuver by the second driver to achieve the same engine sound.

The method 500 begins at 502, which includes receiving inputs including one or more of a throttle position at 504, a braking force at 506, a steering wheel angle at 508, longitudinal and lateral speeds at 510, longitudinal and lateral accelerations at 512, yaw rate at 514, pitch at 516, roll at 518, and velocity at 520. Each of the inputs may be estimated and/or directly measured via sensors arranged onboard the vehicle, such as the two-axis accelerometer and the speed sensor.

The method 500 proceeds to 522, which includes determining if one of the inputs received is greater than a respective threshold. For example, a throttle position may be compared to a threshold throttle position, wherein a position more open than the threshold throttle position may be associated with an aggressive driving behavior and a desired for greater engine noise. In one example, the threshold throttle position may correspond to a 60% open throttle position. However, it will be appreciated that the threshold throttle position may be greater than or less than 60% open throttle position.

As another example, the braking force, which may be correlated to a deceleration rate, may be compared to a threshold braking force. The threshold braking force may be based on a threshold deceleration rate (e.g., 7 m/s or higher). A braking force greater than the threshold braking force may correspond to an aggressive driving behavior, which may also correspond to a desired for louder engine noise.

As another example, the steering wheel angle may be compared to a threshold steering wheel angle. The steering wheel angle, and therefore the threshold steering wheel angle, may be based on a combination of a steering wheel position and a lateral acceleration. The threshold steering wheel angle may be equal to 40 degrees. However, it will be appreciated that the threshold steering wheel angle may be equal to other angles corresponding to aggressive driving behavior. If the steering wheel angle is greater than the threshold steering wheel angle, then the driving behavior may be associated with an aggressive driving behavior. As described above, the steering wheel angle may be a measure of a deviation of the steering wheel from a center position (e.g., 0 degrees). Thus, the steering wheel angle increases as the steering wheel deviates from the center position in a clockwise or a counterclockwise direction.

If the received input is greater than its corresponding threshold, then the method 500 proceeds to 524 and categorizes the driving style as an aggressive driving style. In some examples, additionally or alternatively, the method 500 may account for each variable of the plurality of variables, wherein a function may determine an aggressive driving behavior based on a combination of inputs exceeding their corresponding thresholds. In one example, the function may determine an aggressive driving behavior if three or more of the inputs exceed respective thresholds. The method 500 then proceeds to 526, to determine if the input is greater than a corresponding upper threshold. For example, the steering wheel angle is compared to an upper threshold steering wheel angle, which is greater than the threshold steering wheel angle. If the steering wheel angle is greater than the upper threshold steering wheel angle, then the method 500 proceeds to 528, to learn track behavior inputs. As such, an engine noise map corresponding to the track mode, such as engine noise map 450 of FIG. 4B, may be updated to adjust a position of the exhaust tuning valve based on one or more of the inputs received more closely to a unique driver. In one example, the exhaust tuning valve is maintained in a fully open position to provide a maximum engine noise during the track mode.

As described above, the method 500 may learn behavior for a plurality of vehicle operators (e.g., drivers). As such, the first driver, who is more defensive than the second driver, may produce inputs that correspond to a track behavior that are different than (e.g., lower in magnitude and/or less aggressive) than inputs produced by the second driver. Furthermore, the threshold and upper threshold used to determine if inputs provided by the first driver are aggressive may be less than the same threshold and upper threshold used for the second driver.

If the input received is not greater than its corresponding upper threshold, then the method proceeds to 530 to learn sport behavior inputs. For example, if the steering wheel angle is greater than the threshold steering wheel angle and less than the upper threshold steering wheel angle, then the inputs may be associated with a sport behavior of a particular driver. Additionally or alternatively, an engine sound map associated with the sport behavior of the particular driver may be updated via an algorithm.

Returning to 522, if the input is not greater than the threshold, then the driving style is categorized as a defensive driving style at 532. The method 500 then proceeds to 534, which comprises determining if the input is less than a corresponding lower threshold. For example, if the steering wheel angle is less than a lower threshold steering wheel angle, wherein the lower threshold steering wheel angle is less than the threshold steering wheel angle, then the method 500 proceeds to 536, which includes learning quiet behavior inputs. The inputs may be associated with a quiet behavior for a particular driver of the vehicle and an engine sound map of the quiet behavior for the particular driver may be correspondingly updated to produce desired engine sounds.

If the input is not less than the lower threshold, then the method 500 proceeds to 538, which includes learning moderate behavior inputs. The inputs may be associated with a moderate behavior for a particular driver of the vehicle and an engine sound map of the moderate behavior for the particular driver may be correspondingly updated to produce desired engine sounds.

As mentioned above, the method 500 may learn aggressive and defensive behaviors for a plurality of drivers of the vehicle. As a non-limiting example, for the first, more defensive driver, an aggressive maneuver may be lesser in magnitude than an aggressive maneuver for the second, more aggressive driver. Using steering wheel angle as an example, if the first driver is driving with a steering wheel angle of 30 degrees, then this may be classified as an aggressive behavior, while for the second driver, a steering wheel angle of 50 degrees may be classified as an aggressive behavior. However, during both steering wheel angles, respective engine sounds maps for the first driver and the second driver may result in the exhaust tuning valve moving to the same position to provide the same noise. That is to say, the first driver with the steering wheel angle at 30 degrees results in the exhaust tuning valve being actuated to the same position as the second driver with the steering wheel angle at 50 degrees.

Turning now to FIG. 6, it shows a method 600 for determining a restriction in an exhaust passage. The method 602 begins at 602, which includes determining the driver behavior as described above with respect to FIGS. 2 and 5.

The method 600 proceeds to 604, which includes adjusting the exhaust tuning valve position based on at least one or more of a steering wheel angle, a lateral acceleration, and a longitudinal acceleration. Adjusting the exhaust tuning valve may be based on an engine sound map corresponding to the determined driver behavior.

The method 600 proceeds to 606 to determine if a current sound is equal to an expected sound. For example, if the driver behavior is aggressive and corresponding to a sporty mode, then the method may determine if following actuation of the exhaust tuning valve to a current position that a current sound generated matches an expected and/or a desired sound.

If the sound matches, then the method 600 proceeds to 608 to maintain the exhaust tuning valve in a current position and does not adjust a position of the exhaust tuning valve.

If the current sound does not match the expected sound, then the method 600 proceeds to 610 to determine if the mismatch is due to a misfire. If the mismatch between the current sound and the expected sound is due to a misfire, then the method proceeds to 608 and maintains the valve in the current position.

If the current sound does not match the expected sound and the cause is not a misfire, then the method 600 proceeds to 612 to adjust an exhaust tuning valve position. For example, if the driver behavior is an aggressive driver behavior, then the valve may be adjusted to a more open position, as an exhaust backpressure is higher than expected. As such, a more open position is desired to counteract a restriction in the exhaust passage which is increasing the exhaust backpressure. As another example, if a restriction is present, then the exhaust tuning valve may be moved to a less closed position than a position indicated in an engine noise map. As such, if the exhaust tuning valve is in a position that is more open than a position indicated in an engine sound map corresponding to a defensive driving behavior.

The method 600 proceeds to 614, which includes indicating a presence of an exhaust restriction. In one example, the restriction may be due to a catalyst overloading, such as a particulate filter load being greater than a threshold load. As such, in one example, a regeneration may be initiated in response to the current sound not matching the expected sound.

In this way, an exhaust tuning valve position may be adjusted in response to a steering wheel position, along with a plurality of other inputs, such as a lateral acceleration and a longitudinal acceleration. By adjusting the exhaust tuning valve position, an engine noise may be adjusted to match a driver behavior without a driver behavior being selected by a driver. The technical effect of adjusting the engine sound automatically is to enhance a driving experience. The driver's behavior is automatically determined without the driver selecting their current driver behavior, wherein an engine sound map is selected based on the driver behavior. The exhaust tuning valve position may be adjusted based on positions stored in the engine sound map in response to a steering wheel position, a lateral acceleration, and a longitudinal acceleration.

An embodiment of a method comprises adjusting a position of an exhaust tuning valve arranged in an exhaust passage based on a steering wheel input.

A first example of the method, further includes where the adjusting is further based on an engine sound map corresponding to a current driver behavior.

A second example of the method, optionally including the first example, further comprises where the current driver behavior is an aggressive behavior or a defensive behavior.

A third example of the method, optionally including one or more of the previous examples, further comprises where the adjusting further comprising adjusting the exhaust tuning valve to a position more open during the aggressive behavior than a position during the defensive behavior.

A fourth example of the method, optionally including one or more of the previous examples, further comprises where adjusting the position of the exhaust tuning valve adjusts an engine sound, and wherein the engine sound increases as the position of the exhaust tuning valve is more open.

A fifth example of the method, optionally including one or more of the previous examples, further comprises where indicating a presence of a restriction in the exhaust passage in response to a current engine sound produced via adjusting the position of the exhaust tuning valve based on the steering wheel input being different than a desired engine sound.

A sixth example of the method, optionally including one or more of the previous examples, further comprises where the restriction is an over loaded catalyst.

An embodiment of a system comprises an engine coupled to an exhaust passage comprising an exhaust tuning valve and a controller with computer-readable instructions stored on non-transitory memory thereof that when executed enable the controller to determine a driver behavior based on at least a steering wheel angle input, select an engine sound map corresponding to the driver behavior, and adjust the exhaust tuning valve to a position based on the steering wheel angle input, the engine sound map configured to correlate the steering wheel angle input with a desired engine sound.

A first example of the system further includes where the engine sound map is a defensive sound map or an aggressive sound map.

A second example of the system, optionally including the first example, further comprises where the defensive sound map is a quiet mode sound map or a moderate mode sound map, and wherein the aggressive sound map is a sporty mode sound map or a track mode sound map.

A third example of the system, optionally including one or more of the previous examples, further comprises where the exhaust tuning valve is adjusted and maintained in a fully open position based on the track mode sound map, and wherein the exhaust tuning valve is adjusted between a 10% open position to a 40% open position in the quiet mode.

A fourth example of the system, optionally including one or more of the previous examples, further comprises where the exhaust tuning valve is adjusted to a more open position in response to a given steering wheel angle input when the driver when the aggressive sound map is selected compared to a position of the exhaust tuning valve in response to the given steering wheel angle input when the defensive sound map is selected.

A fifth example of the system, optionally including one or more of the previous examples, further comprises where the instructions further enable the controller to indicate a presence of a restriction in the exhaust passage in response to a current engine sound produced following the exhaust tuning valve being actuated to the position not matching a desired engine sound.

A sixth example of the system, optionally including one or more of the previous examples, further comprises where the instructions further enable the controller to adjust the exhaust tuning valve to a more open position than an expected position based on data in the engine sound map to increase the current engine sound to the desired engine sound.

A seventh example of the system, optionally including one or more of the previous examples, further comprises where the instructions further enable the controller to determine the driver behavior via a plurality of inputs in addition to the steering wheel angle input, the plurality of inputs including one or more of a throttle position, a braking force, a longitudinal velocity, a longitudinal acceleration, a lateral velocity, a lateral acceleration, a yaw rate, a pitch, and a roll.

An eighth example of the system, optionally including one or more of the previous examples, further comprises where the plurality of inputs is estimated or sensed via a two-axis accelerometer sensor and a speed sensor.

An embodiment of a method comprises determining a vehicle operator behavior, selecting an engine sound map based on a classification of the vehicle operator behavior, wherein the classification is based on a plurality of inputs including at least a steering wheel angle input and adjusting a position of an exhaust tuning valve based on a combination of only the steering wheel angle input, a longitudinal acceleration, and a lateral acceleration.

A first example of the method further includes where adjusting the exhaust tuning valve position comprising adjusting the exhaust tuning valve to a fully open position, a fully closed position, and to a position between the fully open and fully closed positions, wherein the defensive behavior comprises two engine noise maps including a quiet mode map and a moderate mode map, wherein the quiet mode map comprises adjusting the exhaust tuning valve between a 10% open position and a 40% open position, wherein the moderate mode map comprises adjusting the exhaust tuning valve between the 10% open position and the fully open position.

A second example of the method, optionally including the first example, further includes where the aggressive behavior comprises two engine noise maps including a sport mode map and a track mode map, wherein the sport mode map comprises adjusting the exhaust tuning valve between the 10% open position and the fully open position, wherein the sport mode map comprises more open exhaust tuning valve positions when the steering wheel angle is below 40 degrees relative to the moderate mode map, and wherein the track mode map comprises adjusting the exhaust tuning valve to only the fully open position for all inputs of the steering wheel angle.

A third example of the method, optionally including one or more of the previous examples, further includes where adjusting the position of the exhaust tuning valve is different during the aggressive behavior and the defensive behavior in response to an identical steering wheel angle input.

In another representation, the exhaust tuning valve is arranged in an exhaust passage of a hybrid vehicle.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

selecting an engine sound map based on a steering wheel input; and adjusting a position of an exhaust tuning valve arranged in an exhaust passage based on the engine sound map and further based on the steering wheel input.

2. The method of claim 1, wherein the engine sound map is one of a plurality of engine sound maps corresponding to a current driver behavior determined by a vehicle control system, wherein the steering wheel input is a steering angle, and wherein with a first engine sound map, a valve opening amount decreases and then increases for increasing steering wheel angle at a given acceleration, and with a second engine sound map, the valve opening is only increased for increasing steering wheel angle at the given acceleration.

3. The method of claim 2, wherein the current driver behavior is determined to be from among each of an aggressive behavior and a defensive behavior.

4. The method of claim 3, wherein the adjusting further comprises adjusting the exhaust tuning valve to a position more open during the aggressive behavior than a position during the defensive behavior.

5. The method of claim 1, wherein adjusting the position of the exhaust tuning valve adjusts an engine sound without adjusting speakers, and wherein the engine sound increases as the position of the exhaust tuning valve is more open.

6. The method of claim 1, further comprising indicating a presence of a restriction in the exhaust passage in response to a current engine sound produced via adjusting the position of the exhaust tuning valve based on the steering wheel input being different than a desired engine sound.

7. The method of claim 6, wherein the restriction is an over loaded catalyst.

8. A system, comprising:

an engine coupled to an exhaust passage comprising an exhaust tuning valve; and a controller with computer-readable instructions stored on non-transitory memory thereof that when executed enable the controller to:

determine a driver behavior based on at least a steering wheel angle input;

select an engine sound map corresponding to the driver behavior; and adjust the exhaust tuning valve to a position based on the steering wheel angle input, the engine sound map configured to correlate the steering wheel angle input with a desired engine sound, wherein a plurality of engine sound maps are applied, and wherein the position of the exhaust tuning valve in response to the steering wheel angle input is different based on a selected engine sound map of the plurality of engine sound maps.

9. The system of claim 8, wherein the engine sound map is a defensive sound map or an aggressive sound map, and wherein the position of the exhaust tuning valve is a further function of an acceleration, and wherein a position of the exhaust tuning valve for a given acceleration and steering wheel input based on the defensive sound map is different than a position of the exhaust tuning valve for the given acceleration and steering wheel input based on the aggressive sound map, and wherein only the exhaust tuning valve is adjusted to generate the desired engine sound.

10. The system of claim 9, wherein the defensive sound map is a quiet mode sound map or a moderate mode sound map, and wherein the aggressive sound map is a sporty mode sound map or a track mode sound map.

11. The system of claim 10, wherein the exhaust tuning valve is adjusted and maintained in a fully open position based on the track mode sound map, and wherein the exhaust tuning valve is adjusted between a 10% open position to a 40% open position in a quiet mode.

12. The system of claim 9, wherein the exhaust tuning valve is adjusted to a more open position in response to a given steering wheel angle input when the aggressive sound map is selected compared to a position of the exhaust tuning valve in response to the given steering wheel angle input when the defensive sound map is selected.

13. The system of claim 8, wherein the instructions further enable the controller to indicate a presence of a restriction in the exhaust passage in response to a current engine sound produced following the exhaust tuning valve being actuated to a desired position based on the steering wheel angle input not matching a desired engine sound.

14. The system of claim 13, wherein the instructions further enable the controller to adjust the exhaust tuning valve to a more open position than an expected position based on data in the engine sound map to increase the current engine sound to the desired engine sound.

15. The system of claim 8, wherein the instructions further enable the controller to determine the driver behavior via a plurality of inputs in addition to the steering wheel angle input, the plurality of inputs including one or more of a throttle position, a braking force, a longitudinal velocity, a longitudinal acceleration, a lateral velocity, a lateral acceleration, a yaw rate, a pitch, and a roll.

16. The system of claim 15, wherein the plurality of inputs is estimated or sensed via a two-axis accelerometer sensor and a speed sensor.

17. A method, comprising:

determining a vehicle operator behavior;

selecting an engine sound map from a plurality of engine sound maps based on a classification of the vehicle operator behavior, wherein the classification is based on a plurality of inputs including at least a steering wheel angle input; and adjusting a position of an exhaust tuning valve based on the engine sound map and a combination of only the steering wheel angle input, a longitudinal acceleration, and a lateral acceleration, and wherein the position of the exhaust tuning valve is different for the plurality of engine sound maps for at least a given steering wheel angle input, longitudinal acceleration, and lateral acceleration.

18. The method of claim 17, wherein adjusting the exhaust tuning valve position comprises adjusting the exhaust tuning valve to a fully open position, a fully closed position, and to a position between the fully open and fully closed positions, wherein the classification include a defensive behavior and an aggressive behavior, wherein the defensive behavior comprises two engine noise maps including a quiet mode map and a moderate mode map, wherein the quiet mode map comprises adjusting the exhaust tuning valve between a 10% open position and a 40% open position, wherein the moderate mode map comprises adjusting the exhaust tuning valve between the 10% open position and the fully open position.

19. The method of claim 18, wherein the aggressive behavior comprises two engine noise maps including a sport mode map and a track mode map, wherein the sport mode map comprises adjusting the exhaust tuning valve between the 10% open position and the fully open position, wherein the sport mode map comprises more open exhaust tuning valve positions when the steering wheel angle is below 40 degrees relative to the moderate mode map, and wherein the track mode map comprises adjusting the exhaust tuning valve to only the fully open position for all inputs of the steering wheel angle.

20. The method of claim 19, wherein adjusting the position of the exhaust tuning valve is different during the aggressive behavior and the defensive behavior in response to an identical steering wheel angle input.

* * * * *